United States Patent [19]

Singer

[11] Patent Number: 4,545,547

[45] Date of Patent: Oct. 8, 1985

[54] CREEL COMPONENT AND CREEL CONSISTING OF SEVERAL COMPONENTS

[75] Inventor: Hans S. Singer, Greenville, S.C.

[73] Assignee: Hans S. Singer Co., Inc., Greenville, S.C.

[21] Appl. No.: 619,384

[22] Filed: Jun. 11, 1984

[51] Int. Cl.[4] ..... B65H 49/02; D02H 1/00; D03J 5/08

[52] U.S. Cl. ..... 242/131

[58] Field of Search ..... 242/130, 131, 131.1; 66/125

[56] References Cited

U.S. PATENT DOCUMENTS 1,465,359 8/1923 Holt et al. ..... 242/131
2,490,874 12/1949 Keight et al. ..... 242/131
2,961,185 11/1960 Seigle ..... 242/130
3,321,152 5/1967 Poore et al. ..... 242/130

*Primary Examiner*—Leonard D. Christian
*Attorney, Agent, or Firm*—Bailey & Hardaway

[57] ABSTRACT

A creel component and a creel manufactured of several such components for textile yarn packages is illustrated having four arms with each arm having a yarn package holder at the end thereof. At a point central to said yarn package holders is a component with at least one yarn guide for the pulling of yarn from the yarn packages mounted on said holders. Above said yarn guides are a yarn tension device, a yarn stop motion, and additional yarn guides. The disclosed arrangement provides for yarn packages positioned closely together with simplified yarn flow so as to produce a creel with compact dimensions.

1 Claim, 7 Drawing Figures

CREEL COMPONENT AND CREEL CONSISTING OF SEVERAL COMPONENTS

BACKGROUND OF THE INVENTION

This invention relates to a creel component and a creel manufactured of several such components for textile yarn packages. With conventional creels the yarn packages are often positioned vertically above each other and horizontally next to each other. Primarily because of the position of the associated yarn guides, considerable space is required. Large yarn packages have to be lifted up to substantial heights.

An important object of this invention is to provide a creel conserving space by positioning packages closely together with simplified yarn flow.

Such a compact positioning of the yarn packages is accomplished utilizing a yarn package holder such as illustrated in U.S. Pat. No. 4,399,957 or an improvement thereon on which an application is being filed contemporaneously herewith, with a short package holding part wedging the carrier of the yarn package.

The object is accomplished utilizing a creel component with package holders having base members superposed and crossed with upturned ends supporting the holders as illustrated in the drawings.

SUMMARY OF THE INVENTION

The creel components consist of two crossed brackets 10 having four arms. The ends of these arms have an approximate Fifty-degree upwardly extending angle and each holds one yarn package holder 20. The position is such that the extended center lines of all yarn packages, mounted on yarn package holders, point towards a central point. At this point is a central mounting component 30 with at least one yarn guide 40 which enables pulling of the yarn f from the yarn packages S and $S_1$ and the yarn packages are tied to S and $S_1$. On a horizontal connecting component 50, positioned above yarn guides 40, are yarn tension device 51, stop motion 52 and yarn guides 53. The creel components can be mounted vertically one above each other and horizontally one next to each other forming a creel. This creel is used to furnish yarn to textile machines.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
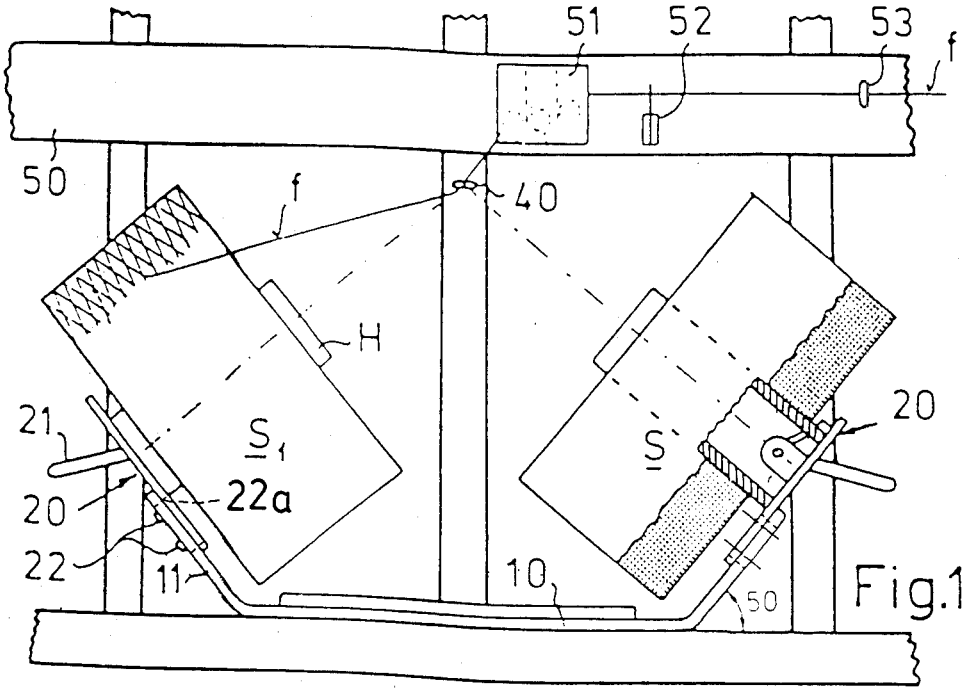
FIG. 1 is a side elevation illustrating a creel element of component with yarn package constructed in accordance with the invention.
Figure 2:
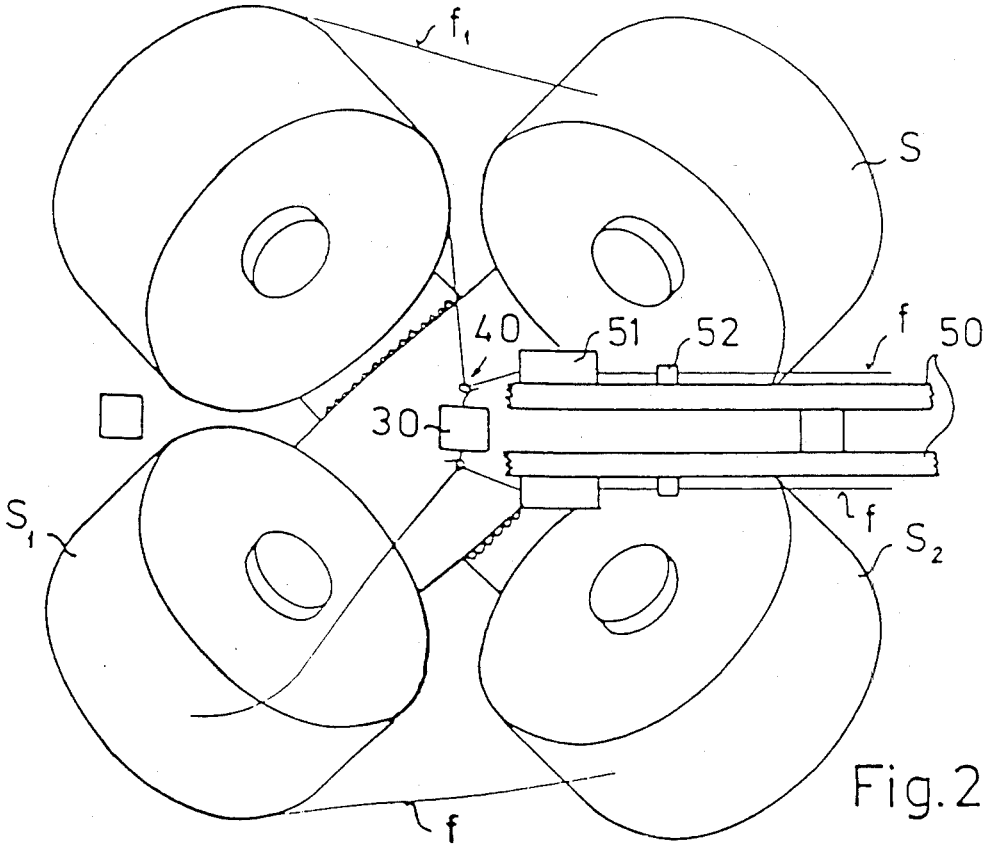
FIG. 2 is a top plan view of the apparatus of FIG. 1.

FIGS. 1 and 2 show the creel component with two horizontal, flat metal bars 10 forming a cross with four arms. The ends 11 of these arms are bent upwards in an angle of approximately Fifty degrees. At the ends of these arms a yarn package holder 20 is mounted with screws 22 for vertical and outward adjustment of the package holders. In the center of these crossing arms is a vertical post 30 holding two yarn guides 40.

In FIG. 1 the arms are shown as if the arms were rotated. FIG. 2 shows the correct executed drawing in top plan view.

FIG. 2 shows how closely together the fully wound yarn packages may be positioned. This is possible because of the short package holding extension of the package holder 20 using minimum space to insert packages. The yarn package holders hold the extended lip of the yarn carrier by wedging action. This package holder is described in U.S. Pat. No. 4,399,957. To release the yarn carrier of an empty yarn package, the release lever 21 is activated and releases the wedging condition holding the yarn carrier.

FIGS. 1 and 2 show a horizontal, mounted support component 50 holding yarn tension device 51, yarn stop motion 52, and yarn guide 53.

Two ends (yarn) f can be pulled from the four yarn packages S. With this arrangement, a continuous running of yarn, except when yarn breaks, is possible. The end of yarn package $S_1$ is connected to the beginning of yarn package $S_2$ with connecting yarn $f_1$ (see FIG. 2). The yarn pulled from yarn package $S_1$ runs through yarn guide 40, through tension device 51, through yarn stop motion 52 and through yarn guides 53 to front of creel. A yarn tension device as described in U.S. Pat. Nos. 4,095,757 and 4,307,850 can be used. Other yarn tension devices can also be used. The yarn stop motion 52 stops the textile machine when yarn breaks.

Should only one yarn be required by the textile machine, such as a loom, the creel component can be mounted with a bushing on a shaft for fully rotational action. This enables connection of the yarn of three yarn packages while the fourth one feeds the loom. Empty yarn packages can easily be removed by rotating the creel to the stationary operator's position. With a rotating creel, the yarn guide is located in the center of the creel component.

Figure 3:
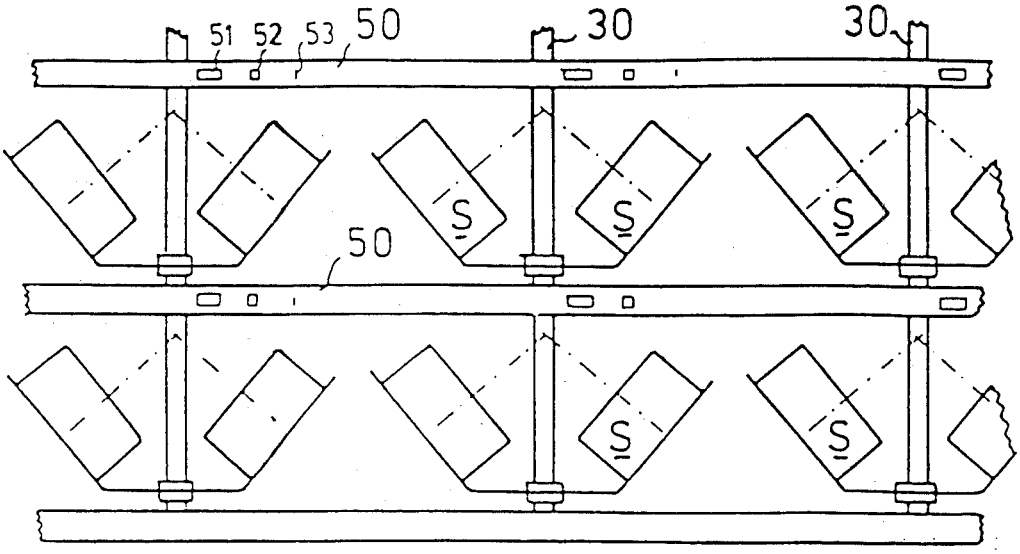
FIG. 3 is a side elevation illustrating a creel made of several components.
Figure 4:
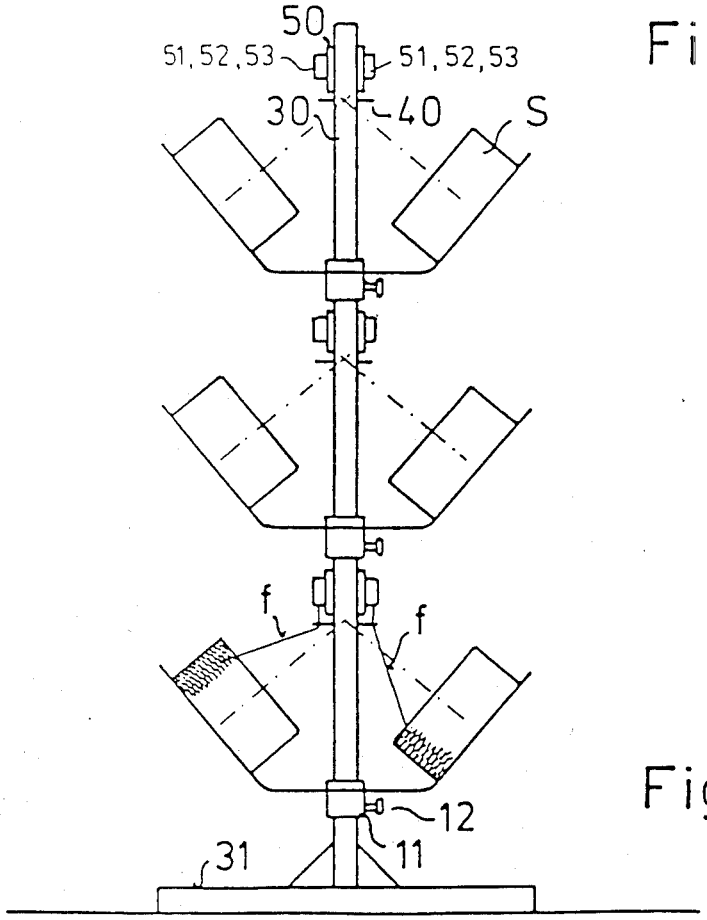
FIG. 4 is a front elevation of a creel at a reduced scale for easier explanation.

FIGS. 3 and 4 show the assembly of several creel components to make creels for textile machines. The post 30 holds several creel components above each other, and the horizontal mounting support 50 connects several of the creel components above each other and next to each other creating a creel with any amount of yarn packages for textile machines processing yarn. Under each post 30 is a connecting member 31.

FIG. 4 shows that each creel component can be vertically adjusted. The creel component is equipped with a bushing 11 and can be adjusted to the desired height on post 30 with a set screw 12. Horizontal mounting supports 50 can also be vertically adjusted on post 30.

The package holders as described earlier are mounted to brackets 10. The mounting plates and/or the mounting brackets are equipped with slots **22*a* through which pass the threaded features 22**, and the yarn package position can be vertically and outwardly adjusted according to yarn package size.

Figure 5:
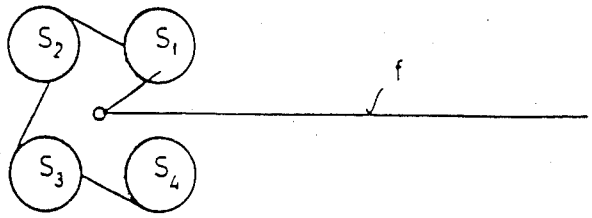
FIGS. 5–7 are diagrams illustrating various systems in which the creel components can be used.
Figure 6:
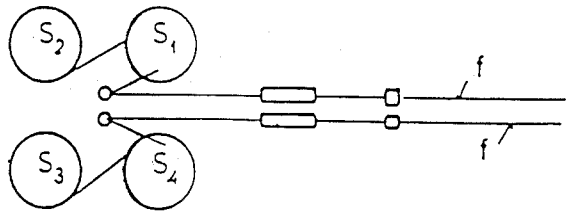
Figure 7:
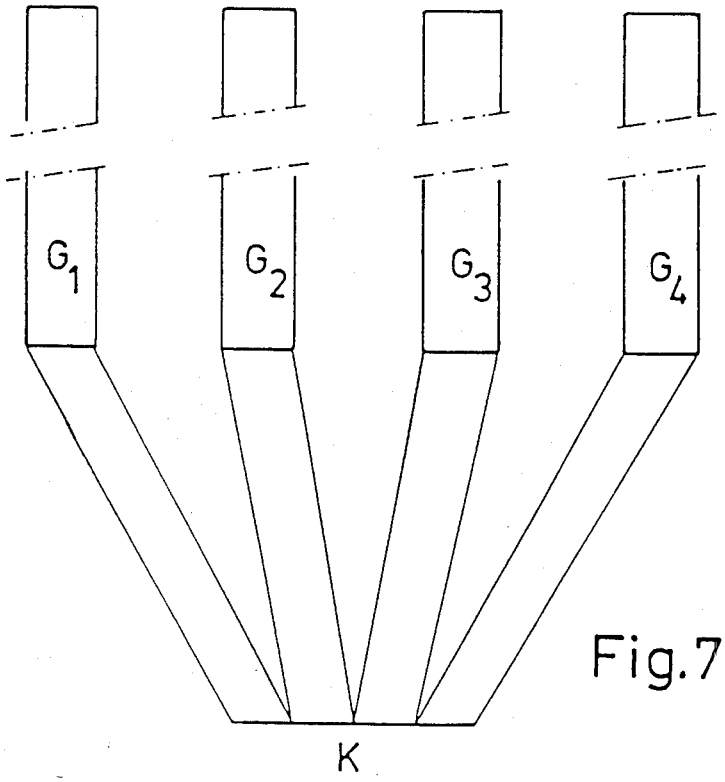

FIGS. 5, 6, and 7 show different embodiments of creel components schematically drawn.

FIG. 5 shows a rotating creel component where all four yarn packages connected to each other. If yarn from yarn package $S_1$ is processed, yarn from yarn package $S_2$ is processed and so forth. By replacing empty yarn packages with full ones a continuous processing of yarn is accomplished.

FIG. 6 shows a creel having multiple components. Yarn packages S1, S2, and S3, S4 are connected with each other, and two running yarns are to be pulled from such a creel component.

FIG. 7 shows a creel with four creel component units $G_1$–$G_4$. Each unit has seventeen horizontal creel components and four vertical creel components. Each creel component holds four yarn packages. This means 136 ends (yarns) can be processed from each unit. The total number of ends (yarns) processed from such a creel is 544.

A creel with 552 running ends (yarns) and twelve-inch diameter yarn packages has a height of six feet seven inches, a length of forty-six feet, and width of twelve feet; this is less than half the space consumption of a conventional creel.

While a preferred embodiment of the invention has been described using specific terms, such description is for illustrative purposes only, and it is to be understood that changes and variations may be made without departing from the spirit or scope of the following claims.

What is claimed is:

1. A creel component for supporting a plurality of yarn package holders on the same horizontal level, and yarn guides located at a central point, said component comprising:

a plurality of bracket portions formed of flat base with yarn package holders mounted at a free upturned end of each bracket portion, said yarn package holders being positioned such that the extended center line of the mounted yarn packages extends toward said central point; and an extension of several of said upturned end of each said bracket portion having slot means and fasteners for adjustably attaching said extensions to each said end;

whereby said yarn package holders are vertically and outwardly adjustable on said upturned ends for accommodating various-sized packages.

* * * * *